US005337505A

United States Patent [19]

Brown et al.

[11] Patent Number: 5,337,505

[45] Date of Patent: Aug. 16, 1994

[54] TOOL KIT FOR CLEANING FIREARMS

[76] Inventors: Donald E. Brown; David L. Brown, both of P.O. Box 1661, Waterbury, Conn. 06721

[21] Appl. No.: 24,366

[22] Filed: Mar. 1, 1993

[51] Int. Cl.[5] ..... F41A 29/02

[52] U.S. Cl. ..... 42/95; 15/104.165; 15/104.2; 15/145

[58] Field of Search ..... 42/95, 96; 15/143.1, 15/144.2, 145, 104.16, 104.165, 104.2

[56] References Cited

U.S. PATENT DOCUMENTS

| | | | |
|---|---|---|---|
| 2,897,525 | 8/1959 | Goodwin et al. | 42/95 |
| 4,680,824 | 7/1987 | Lieptz | 15/104.65 |
| 4,716,673 | 1/1988 | Williams et al. | 42/95 |
| 4,901,464 | 2/1990 | Banoun | 42/95 |
| 4,901,465 | 2/1990 | Hsu | 42/95 |
| 5,133,101 | 7/1992 | Hauser et al. | 15/143.1 |

*Primary Examiner*—Stephen C. Bentley
*Attorney, Agent, or Firm*—E. Michael Combs

[57] ABSTRACT

A complete tool kit for cleaning firearms is disclosed. The tool kit utilizes a support rod constructed of rigid polymeric material. The tool kit further includes a rigid stainless steel brush, a combination brush composed of separate rigid polymeric and bronze brushes, a rotary bronze bore brush, a rigid spear point, as well as a rotary bore drying and cleaning attachment using a pair of cloth patches. The support rod is provided with threaded bores in its opposite ends for selectively mounting the noted brushes, spear point, and drying attachment in any selected positional array on the rod ends. A tubular foam rubber pad is positionable around either the support rod, an extension bar, or handle member to facilitate manipulation of a tool kit assembled from the kit. A plurality of support rod extension bars are attachable to either end of the support rod and to the facing ends of each other to increase the length of the support rod. A rod handle element is attachable to an end of either an extension bar or the support rod to provide further manipulative control of an extended length tool assembled from the kit.

11 Claims, 3 Drawing Sheets

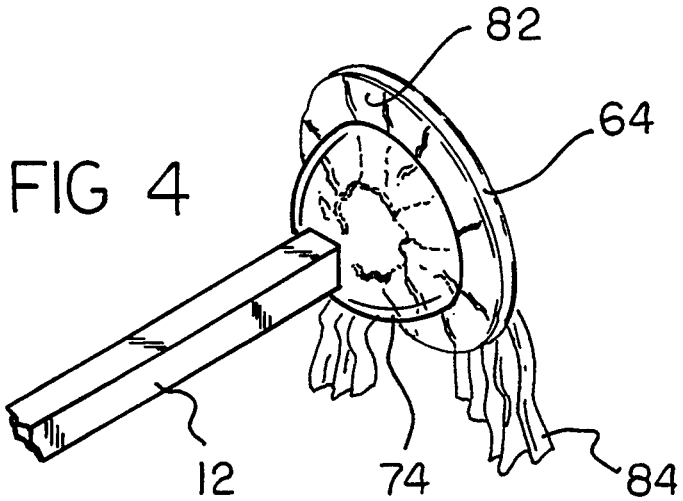
FIG 4
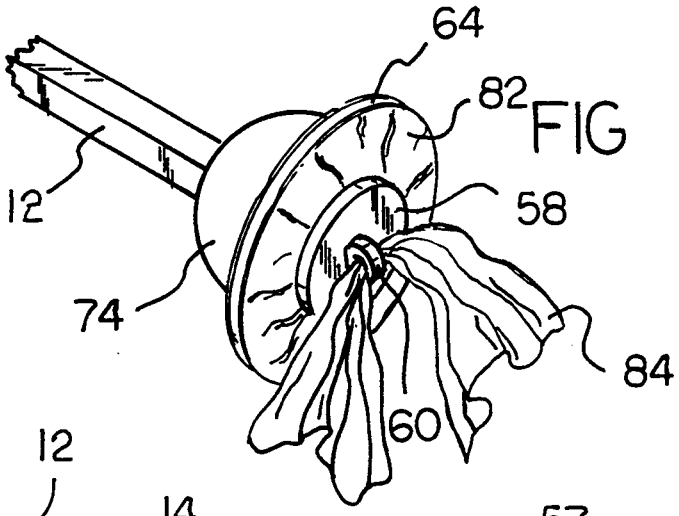
FIG 5
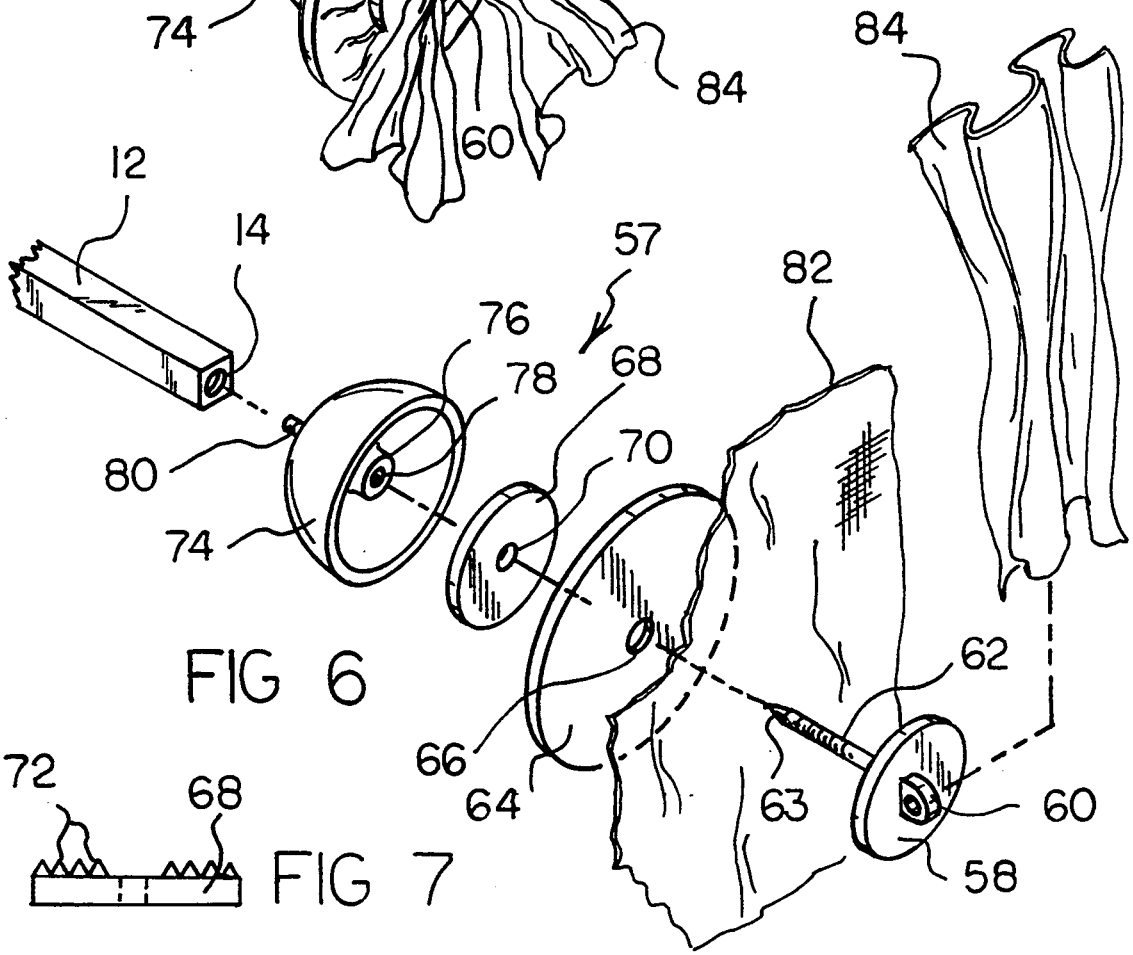
FIG 6
FIG 7

TOOL KIT FOR CLEANING FIREARMS

BACKGROUND OF THE INVENTION

1. Field of the Invention

The field of the invention relates to firearm cleaning devices, and more particularly to a complete tool kit for cleaning firearms.

2. Description of the Prior Art

In the past, and particularly in the military environment, cleaning of firearms was effected by the standard issue olive drab toothbrush which enabled the removal of dust, dirt, and grime from such weapons as the M-14 series rifles which were primarily made of wood. However, the subsequent development of more advanced weapons such as the M-16 series rifles which are primarily constructed of steel, rendered the use of the standard toothbrushes obsolete due to their inability to remove rust and corrosion from the metal surfaces. Accordingly, a more effective and complete firearm cleaning tool was required to not only remove dust, dirt, and grime, but also to remove rust and corrosion from the metal surfaces of the newer weapons.

Various firearm cleaning devices have been utilized in the prior art. For example, U.S. Pat. No. 4,144,609 to Dubs sets forth a segmented brush for cleaning firearm bores and gun barrels which includes a central spindle rod with a plurality of freely rotatable circular brush units fixed on the spindle between end and transition pieces thereon.

U.S. Pat. No. 4,901,465 to Hsu discloses a rifle gun barrel cleaning device including a cleaning rod having a plurality of detachable sections. Several types of cleaning tools are provided for selectable attachment to the cleaning rod which in turn is secured to a tubular casing. The tool can be dismantled and stored in the tubular casing which serves as a handle during use.

U.S. Pat. No. 4,930,240 to Bice illustrates another gun barrel cleaning device comprising a shaft having a head at one end thereof adapted for connection with a driving member for rotating the shaft in either a forward or reverse direction in a gun barrel. A plurality of cleaning implements are selectively and detachably mountable on the shaft.

U.S. Pat. No. 4,949,496 to Stephan provides a brush for cleaning a clip receptacle of a gun comprising an assembly having an operating handle at one end and a cleaning brush at an opposite end thereof, wherein the cross-sectional shape of the cleaning brush matches that of the clip receptacle.

U.S. Pat. No. 5,028,509 to Stephan discloses a combination gun cleaning brush comprising a handle, a barrel cleaning brush mounted on one end of the handle, and a magazine and magazine receiver cleaning brush mounted on the opposite end of the handle.

U.S. Pat. No. 5,075,998 to Selleck illustrates still another gun cleaning apparatus which includes a rod, a swivel handle mounted on one end of the rod, and a freely rotating barrel cleaning brush mounted on the opposite end of the rod.

As such, it may be appreciated that there continues to be a need for a new and improved tool kit for cleaning firearms which addresses both the problems of ease of use, portability, and effectiveness in construction, and in this respect, the present invention fulfills this need.

SUMMARY OF THE INVENTION

In view of the foregoing disadvantages inherent in the known types of firearm cleaning devices now present in the prior art, the present invention provides a tool kit for cleaning firearms which comprises a complete set of cleaning implements for effectively removing dust, dirt, grime, rust, and corrosion from all of the surfaces, openings, cavities, and bores of firearms. As such, the general purpose of the present invention, which will be described subsequently in greater detail, is to provide a new and improved tool kit for cleaning firearms which has all the advantages of the prior art firearm cleaning devices and none of the disadvantages.

To attain this, the present invention includes a complete tool kit for cleaning firearms as set forth herein. The tool kit utilizes a support rod constructed of rigid polymeric material. The kit further includes a rigid stainless steel brush, a combination brush composed of separate rigid polymeric and bronze brushes, a rotary bronze bore brush, a rigid spear point, as well as a bore drying add cleaning attachment using a pair of cloth patches. The support rod is provided within threaded bores in its opposite ends for selectively mounting the noted brushes, spear point, and drying attachment in any selected positional array on the rod ends. A tubular foam rubber pad is positionable around either the support rod, an extension bar, or the handle member rod to facilitate manipulation of a tool assembled from the kit. A plurality of support rod extension bars are attachable to either end of the support rod and to the facing ends of each other to increase the length of the support rod. A rod handle member is attachable to an end of either an extension bar or the support rod to provide further manipulative control of an extended length tool assembled from the kit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved tool kit for cleaning firearms which has all the advantages of the prior art firearm cleaning devices and none of the disadvantages.

It is another object of the present invention to provide a new and improved tool kit for cleaning firearms which may be easily and efficiently manufactured and marketed.

It is a further object of the present invention to provide a new and improved tool kit for cleaning firearms which is of durable and reliable construction.

An even further object of the present invention is to provide a new and improved tool kit for cleaning firearms which is susceptible of a low cost of manufacture with regard to both materials and labor, and which accordingly is then susceptible of low prices of sale to the consuming public, thereby making such tool kits for cleaning firearms economically available to the buying public.

Still yet another object of the present invention is to provide a new and improved tool kit for cleaning firearms which provides in the apparatuses and methods of the prior art some of the advantages thereof, while simultaneously overcoming some of the disadvantages normally associated therewith.

Still another object of the present invention is to provide a new and improved tool kit for cleaning firearms which has a multi-functional set of implements to effect a complete cleaning of the firearms, thereby eliminating the wasteful and time-consuming search for locating adequate implements to properly clean the firearms.

Yet another object of the present invention is to provide a new and improved tool kit for cleaning firearms which has a wide range of usage including the military, civilian law enforcement agencies, as well as anyone who owns a firearm.

Even still another object of the invention is to provide a new and improved tool kit for cleaning firearms which has a plurality of wear-sensitive cleaning implements which are readily replaceable, thereby eliminating any non-productive down time of the tool kit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of the cleaning and drying attachment mounted on the end of the support rod of the present invention.

FIG. 5 is another perspective view of the cleaning and drying attachment mounted on the end of the support rod of the present invention.

FIG. 6 is an exploded perspective view of the cleaning and drying attachment mounted on the end of the support rod of the present invention.

FIG. 7 is an elevational view of the cloth patch securing disc shown in FIG. 6.

DESCRIPTION OF THE PREFERRED EMBODIMENT

Figure 1:
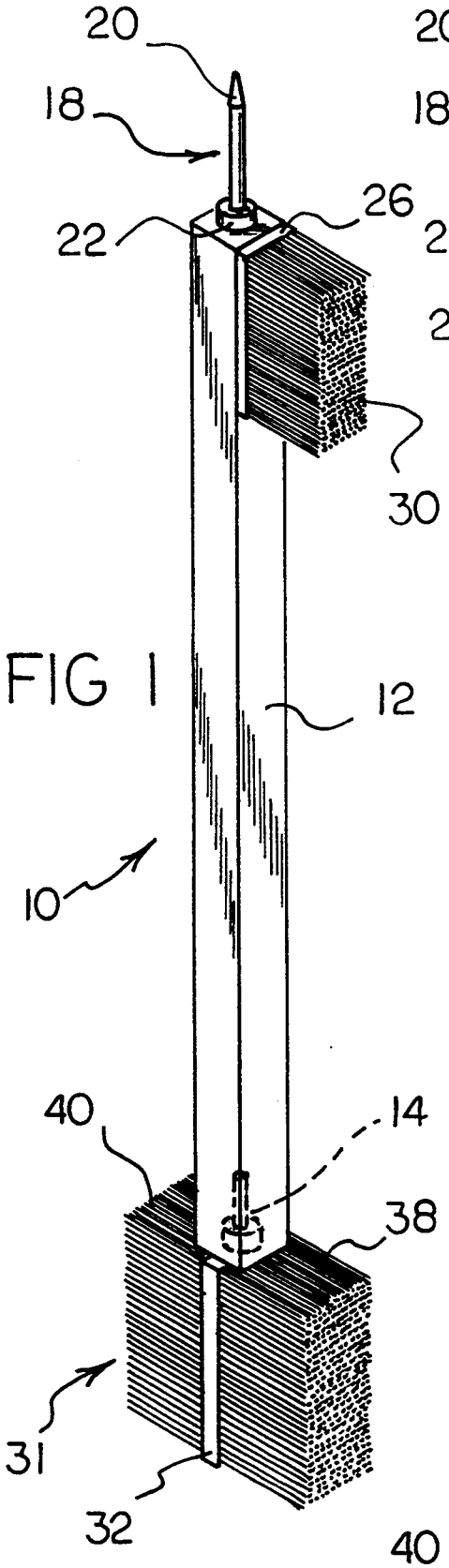
FIG. 1 is a perspective view of a portion of the tool kit of the present invention illustrating the stainless steel brush, combination brush, and the spear point mounted on the support rod.

With reference now to the drawings, and in particular to FIGS. 1–7 thereof, a new and improved tool kit for cleaning firearms embodying the principles and concepts of the present invention and generally designated by the reference numeral 10 will be described.

Figure 2:
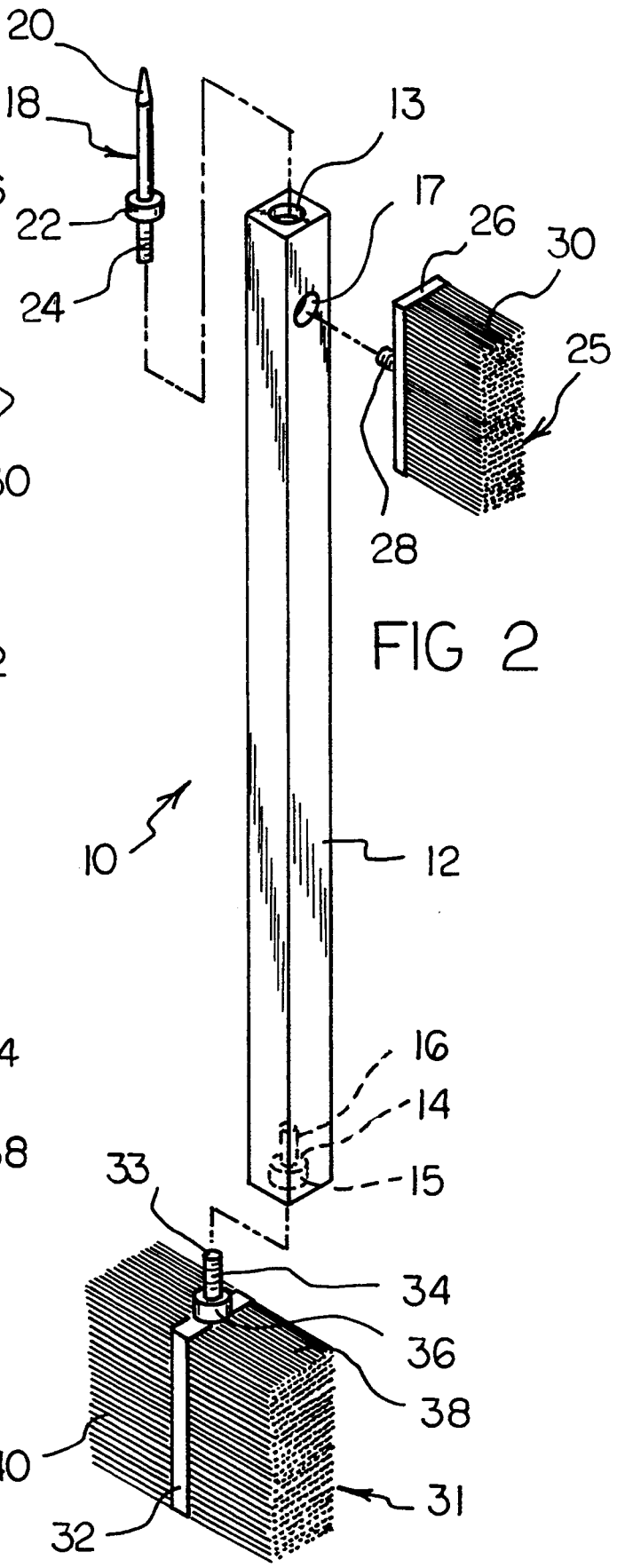
FIG. 2 is an exploded perspective view of a portion of the tool kit of the present invention as illustrated in FIG. 1.

More specifically, and with particular reference to FIGS. 1 and 2, tool kit 10 includes an elongate support rod 12 having a mounting bore 13 at one end thereof, and a mounting bore 14 at an opposite end thereof. Support rod 12 is preferably rectangular and composed of rigid polymeric material. Adjacent to mounting bore 13 in one end of support rod 12 is a mounting bore 17 extending into the support rod 12 from a side surface thereof. All three mounting bores 13,14, and 17 are structurally identical and include a larger diameter, unthreaded section 15 beginning at a support rod surface, and an adjoining smaller diameter threaded section 16 extending inwardly from section 15. An elongate brass spear point or jag 18 is provided with a sharp tip 20 at one end, an enlarged intermediate section 22, and a threaded section 24 at an opposite end. Spear point 18 is mountable on either end of support rod 12 by threading its end section 24 into either bore 13,14, or 17 so that threaded section 24 is seated in complementary section 16 and intermediate portion 22 is received in complementary section 15. Spear point 18 is used as a "pick" to clean small firearm openings. A further cleaning implement comprises a first brush 25 having a base member 26 which is preferably rectangular and composed of rigid polymeric material. A threaded mounting pin 28 which is structurally identical to sections. 22 and 24 of spear point 18 is secured to and extends outwardly from the center of one planar surface of base member 26. Mounted on and extending outwardly from the opposed planar surface of base member 28 is a brush element 30 composed of stainless steel bristles for cleaning metal surfaces. In the same manner as spear point 18, first brush 25 is also mountable on either end of support rod 12 by threading mounting pin 28 into either complementary bore 13,14, or 17 so that pin 28 is seated in any selected bore in the same manner as spear point sections 22 and 24. Another cleaning implement of tool kit 10 comprises a combination second brush 31 having a base member 32 which is preferably rectangular and composed of rigid polymeric material such as Nylon. A threaded mounting pin 33 is secured to and extends outwardly from the center of one end face of base member 32. The mounting pin 33 includes a threaded section 34 and an integral and enlarged head section 36 which is secured to the end face of base member 32. Mounted on and extending outwardly from one planar surface of base member 32 is a brush element 38 composed of polymeric bristles for cleaning non-metallic surfaces. Mounted on and extending outwardly from the opposite planar surface of base member 32 is a brush element 40 composed of bronze bristles for cleaning metallic surfaces. The combination second brush 31 is also mountable on either end of support rod 12 by threading mounting pin 33 into either complementary bore 13,14, or 17 so that pin 33 is seated in any selected bore in the same manner as spear point sections 22 and 24 and mounting pin 28. A tubular foam rubber gripper pad 41 (shown in FIG. 3) is mountable around a middle portion of support rod 12 to facilitate the non-slipping manipulation of the tool as configured in FIGS. 1 and 2. Pad 41 is slipped onto rod 12 before spear point 18 and the first and second brushes are mounted on the ends of rod 12. Accordingly, with the described arrangement of identical structural mounting means for spear point 18, and brushes 25 and 31, i.e. complementary bores 13,14, and 17 and sections 22,24 and pins 28,33, tool kit 10 has maximum configurational flexibility to adapt to firearms of varying shapes. Further, the mating enlarged sections 15 of the threaded mounting bores 13,14, and 17 and those of the threaded mounting pins 22,24, 28, and 33 provide a stable connection between the cleaning implements 18,25, and 31 and the support rod 12. Still further, its multi-functional implements are easy to replace.

Figure 3:
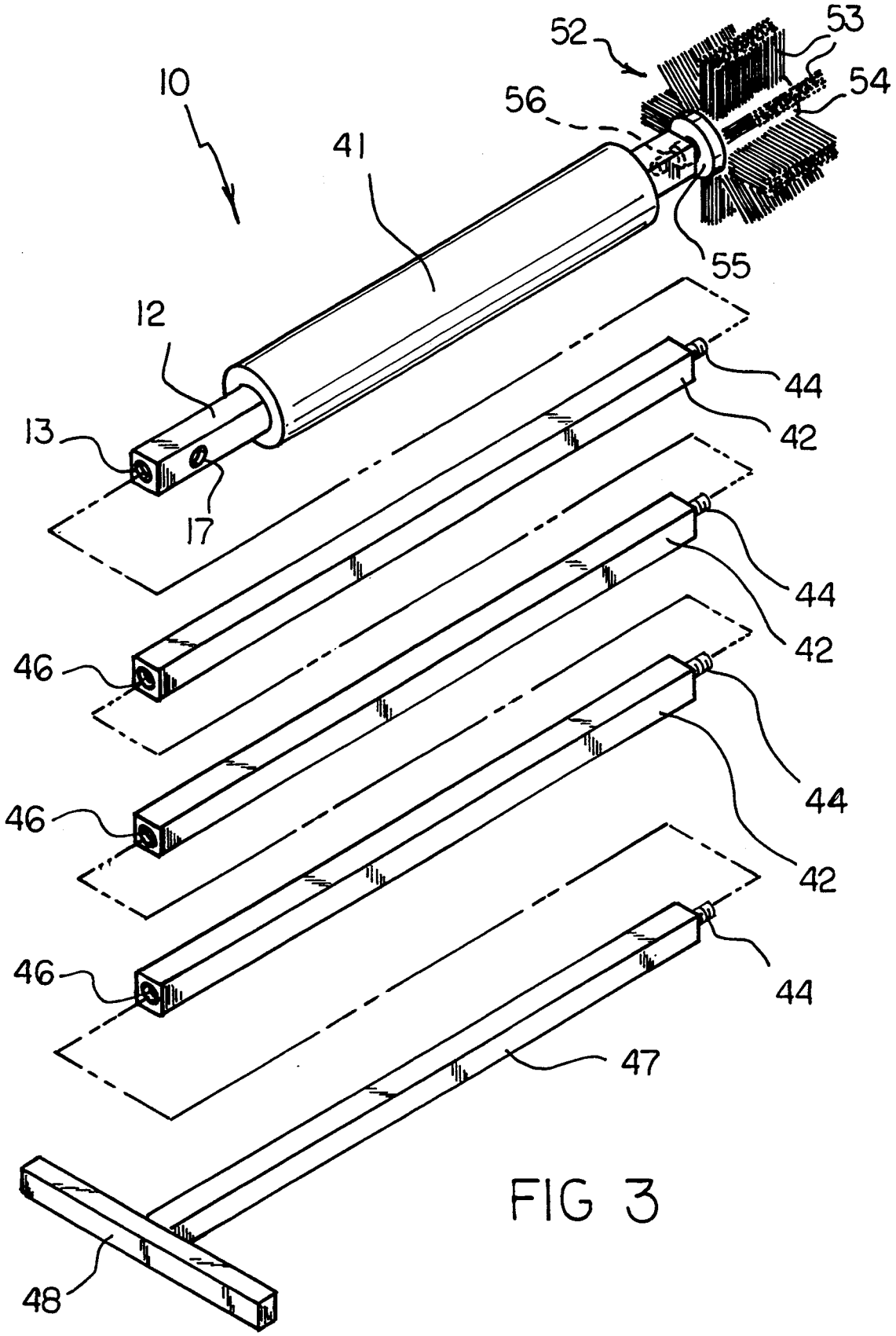
FIG. 3 is an exploded perspective view of a portion of the tool kit of the present invention illustrating the rotary bore brush and the rubber pad mounted on the support rod, the plurality of extension bars, and the rod handle element.

Referring now to FIG. 3, the tool kit 10 further comprises a plurality of identically configured support rod extension bars 42. Each extension bar 42 has a threaded mounting pin 44 mounted on and extending outwardly from one end face thereof. Pins 44 are identical to sections 22 and 24 of spear point 18 and mounting pins 28 and 33. Extending inwardly into the opposite end face of each extension bar 42 is a threaded mounting bore 46. Bores 46 are identical to bores 13, 14, and 17 and complementary in shape to pins 44. A rod handle member 47 is also provided and has a threaded mounting pin 44 mounted on and extending outwardly from one end thereof and an elongate, laterally-extending handle 48 mounted on the opposite end thereof. The tool kit 10 further includes a rotary bore cleaning brush 52 comprising a plurality of bronze brushes 53 mounted in spaced relationship on the periphery of a cylindrical hub member 54 which is rotatably mounted on a connecting pin 55. Pin 55 has a threaded mounting pin 56 attached to and extending outwardly from one planar thereof. Pin 56 is structurally identical to sections 22 and 24 of spear point 18, and mounting pins 28 and 33. Cleaning brush 52 is mountable on either end of support rod 12 by threading mounting pin 56 thereof into either complementary bore 13 or 14 so that pin 56 is seated in either bore 13 or 14 in the same manner as spear point sections 22 and 24, and mounting pins 28 and 33 are seated in either bore 13,14, or 17. When cleaning firearm bores, rotary brush 52 may be mounted on either end of support rod 12, i.e. in either bore 13 or 14 as previously described. If the firearm bore is short, rod handle member 47 may be attached to an opposite end of rod 12, i.e. by threading mounting pin 44 on its end into either bore 13 or 14. With this arrangement, the tool is reciprocated and manipulated in the firearm bore by grasping and either pushing or pulling on handle 48. If the firearm bore is longer, one or more extension bars 42 and the handle member 47 may be mounted on one end of support bar 12, and brush 52 may be mounted on the opposite end of support bar 12. This configuration of the tool may then be reciprocated in the firearm bore in the same manner. Alternatively, tool may be elongated further by mounting one or more extension bars 42 and handle member 47 on one end of support bar 12, and one or more extension bars 42 and brush 52 may be mounted on the opposite end of support bar 12. Gripper pad 41 may be slipped over either handle member 47 or an adjacent extension bar 42 to add further manipulative control to the extended length tool. Use of the rotary cleaning brush 52 prevents scratching of the firearm bore and damaging of its rifling.

Similarly, extension bars 42 and handle member 47 are equally usable with the tool as configured in FIGS. 1 and 2. A selected cleaning implement, i.e. either spear point 18, brush 25, or brush 31, may be mounted on either end of support rod 12, and handle member 47 may be mounted on the opposite end thereof. To further elongate the tool, one or more extension rods 42 and a selected cleaning implement may be mounted on one end of support bar 12, and one or more extension bars 42 and handle member 47 may be mounted on the opposite end of support rod 12. Gripper pad 41 may be slipped over either support rod 12, an extension bar 42, or handle 47 to enhance manipulative control.

As illustrated in FIGS. 4–7, tool kit 10 further includes a firearm bore cleaning and drying attachment or implement 57 for performing a finish cleaning and drying operation after the bore has been brushed with rotary brush 52 mounted on support rod 12 in the tool arrangement described in the preceding paragraph. Attachment 57 is effective to remove any remaining dirt and grime, as well as any solvents, oils, and moisture therefrom to thereby completely dry the bore. Attachment 57 includes an eye disc 58 having an eye member 60 secured to and extending outwardly from the center of a planar surface of disc 58. Secured to and extending outwardly from the center of an opposed planar surface of disc 58, in axial alignment with eye member 60, is a threaded mounting shaft 62 having a sharp pointed tip 63 at its outer end. A flexible cleaning and drying disc 64 is further provided and has a center hole 66 extending therethrough. Disc 64 is preferably constructed of rubber. As shown in FIGS. 6 and 7, a cloth patch securing disc 68 is provided and has a center threaded hole 70 extending therethrough. A plurality of sharp cloth securing teeth 72 are integral with and extend outwardly from a planar surface of disc 68. A cup or bell-shaped mounting base 74 has a boss 76 therein which is integral with a bottom portion thereof and extends upwardly and centrally within base 74. Boss 76 has a centrally positioned threaded bore 78 therein. Secured to and extending outwardly from an outer surface of the bottom portion of base 74 is a centrally positioned threaded mounting pin 80 which is axially aligned with threaded bore 78. Pin 80 is structurally identical to sections 22 and 24 of spear point 18, and mounting pins 28,33, and 44. To assemble attachment 57 for use, shaft 62 of eye disc 58 is pushed through the center of a cloth patch 82 which is moved along shaft 62 and pressed against the planar surface of disc 58. Rubber disc 64 is placed on shaft 62 through its hole 66 and pressed against cloth 82. Securing disc 68 is threaded onto shaft 62 through its threaded hole 70 until it is pressed against rubber disc 64. The outer portions of cloth 82 are then folded over the rubber disc 64 and pressed against the sharp teeth 72 of disc 68 to secure patch 82 in place. Shaft 62 is then threaded into bore 78 until rubber disc 64 is pressed against the peripheral rim of base 78. A second cloth patch 84 is slipped into eye member 60 which completes the assembly of attachment 57. In use, attachment 57 is mounted on either end of support rod 12 by threading mounting pin 80 into either complementary bore 13 or 14 in the same manner as brush 52. With attachment 57 mounted on one end of support bar 12 and handle member 47 mounted on the opposite end of support bar 12, the tool is reciprocated in a firearm bore to finish clean and dry it. In this manner, cleaning and drying is effected in both two stages and in two directions. Two stage cleaning is effected by using two sequentially acting patches, i.e. cloth patch 84 and cloth patch 82 covering rubber disc 64 which conforms tightly to the surface of the firearm bore and cleans more thoroughly. Further, two stage cleaning is effected in two directions, i.e. when the tool is pushed in one direction and pulled in the opposite direction due to the ability of rubber disc 64 to flex and conform to the firearm bore when moved in opposite directions and thereby accomplish a more thorough cleaning and drying of the bore. When using attachment 57, the support bar 12 may also be elongated using extension bars 42 and handle member 47 in the identical manner as described with respect to brush 52.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tool kit for cleaning firearms comprising:

an elongate support member having a pair of opposed ends;

first securing means on one of said ends of said support member, wherein said first securing means includes a first threaded bore extending into said support member from an end face at said one end thereof, and a second threaded bore extending into said support member from a side surface thereof adjacent said end face;

second securing means on an opposed end of said support member, wherein said second securing means includes a third threaded bore extending into said support member from an opposed end face at said opposed end thereof, said first, second, and third threaded bores being structurally identical;

first cleaning means;

first attachment means on said first cleaning means and engageable with said first and second securing means for selectively and detachably mounting said first cleaning means on either of said opposed ends of said support member;

second cleaning means;

second attachment means on said second cleaning means and engageable with said first and second securing means for selectively and detachably mounting said second cleaning means on either of said opposed ends of said support member;

third cleaning means;

third attachment means on said third cleaning means and egageable with said first and second securing means for selectively and detachably mounting said third cleaning means on either of said opposed ends of said support member;

fourth cleaning means;

fourth attachment means on said fourth cleaning means and engageable with said first and second securing means for selectively and detachably mounting said fourth cleaning means on either of said opposed ends of said support member;

fifth cleaning means; and fifth attachment means on said fifth cleaning means and engageable with said first and second securing means for selectively and detachably mounting said fifth cleaning means on either of said opposed ends of said support member, wherein said first, second, third, fourth, and fifth attachment means each comprise a respective first, second, third, fourth, and fifth threaded mounting pin secured to their respective first, second, third, fourth, and fifth cleaning means, said threaded mounting pins being structurally identical.

2. The tool kit for cleaning firearms as set forth in claim 1, wherein said support member is a substantially rectangular rod composed of rigid polymeric material;

wherein said first cleaning means is an elongate spear point;

wherein said second cleaning means is a first brush having bristles of stainless steel;

wherein said third cleaning means is a combination second brush having a first section with bristles of polymeric material and a second section with bristles of bronze;

wherein said fourth cleaning means is a third brush having a plurality of third brush sections with bristles of bronze; and wherein said fifth cleaning means is a cleaning and drying attachment.

3. The tool kit for cleaning firearms as set forth in claim 2, wherein said spear point has a sharp point on one end thereof and said first threaded mounting pin at on opposite end thereof.

4. The tool kit for cleaning firearms as set forth in claim 2, wherein said third brush includes a cylindrical base member, wherein said third brush sections are mounted in spaced relationship around the periphery of said base member, and wherein said fourth threaded mounting pin is rotatably mounted on one end of said base member.

5. The tool kit for cleaning firearms as set forth in claim 2, wherein said cleaning and drying attachment includes an eye disc, an eye member for receiving a first cloth patch therein, said eye member secured to and extending centrally outwardly from one planar surface of said eye disc, a threaded mounting shaft secured to and extending centrally outwardly from an opposed planar surface of said eye disc, said threaded mounting shaft having a pointed tip at an outer end thereof, a resilient cleaning and drying disc having a central hole extending therethrough, a cloth patch securing disc having a central threaded hole extending therethrough, a plurality of sharp cloth patch securing teeth secured to and extending outwardly from one planar surface of said cloth patch securing disc for fixing a second cloth patch around said drying and securing discs, and a bell-shaped mounting base having a boss positioned therein and extending centrally upwardly from an inner surface of a bottom portion thereof, said boss having a threaded central bore therein, wherein said fifth threaded mounting pin is secured to and extends centrally outwardly from an outer surface of said bottom portion of said mounting base in axial alignment with said threaded central bore of said boss, and wherein said threaded mounting shaft extends centrally through said second cloth patch, extends through said central hole of said drying disc, is threadably engaged with and extends through said central threaded hole of said securing disc, and extends into and is threadably engaged with said threaded central bore of said boss to secure said eye disc with said first cloth patch, said second cloth patch, said resilient cleaning and drying disc, said securing disc, and said bell-shaped base in assembled relationship for use in cleaning firearm bores.

6. The tool kit for cleaning firearms as set forth in claim 5, wherein said resilient cleaning and drying disc is composed of rubber.

7. The tool kit for cleaning firearms as set forth in claim 1, and further comprising a plurality of support member extension bars, each of said extension bars having a pair of opposed ends, third securing means on one end of each extension bar, and sixth attachment means on an opposed end of each extension bar, said third securing means being engagable with said first, second, third, fourth, and fifth attachment means for selectively and detachably mounting said first, second, third, fourth, or fifth cleaning means on said one end of any of said extension bars, said third securing means being further engagable with said sixth attachment means for selectively and detachably connecting any number of said extension bars to each other to elongate the support member.

8. The tool kit for cleaning firearms as set forth in claim 7, and further comprising a handle member having a pair of opposed ends, a gripper bar secured to one of said ends and extending laterally thereof, and a seventh attachment means secured to an opposed end for selectively and detachably mounting said handle member on either of said opposed ends of said support rod, or on one end of any of said extension bars.

9. The tool kit for cleaning firearms as set forth in claim 8, wherein said third securing means includes a fourth threaded bore extending into said extension bar from one end face at said one end of said extension bar;

wherein said sixth attachment means includes a sixth threaded mounting pin secured to and extending outwardly from an opposed end face at said opposed end of each of said extension bars;

wherein said seventh attachment means includes a seventh threaded mounting pin secured to and extending outwardly from said opposed end of said handle member; and wherein said fourth threaded bore is structurally identical to said first, second, and third threaded bores, and said sixth and seventh threaded mounting pins are structurally identical to said first, second, third, fourth, and fifth threaded mounting pins.

10. The tool kit for cleaning firearms as set forth in claim 9, wherein each of said first, second, third, and fourth threaded bores, and each of said first, second, third, fourth, fifth, sixth, and seventh threaded mounting pins includes a larger diameter unthreaded section, and an adjoining, smaller diameter threaded section having a length greater than that of said unthreaded section.

11. The tool kit for cleaning firearms as set forth in claim 8, and further comprising a resilient tubular gripper pad which is selectively and detachably mountable around either the support rod, any of said plurality of extension bars, or said handle member to enhance gripping and manipulation of a tool assembled from said kit.

* * * * *